US008199029B2

(12) United States Patent
Bell et al.

(10) Patent No.: US 8,199,029 B2
(45) Date of Patent: Jun. 12, 2012

(54) COMBINED SMOKE DETECTOR AND LIGHTING UNIT

(75) Inventors: Kenneth F. Bell, Raleigh, NC (US); Robert J. Antolick, Wilson, NC (US)

(73) Assignee: Kidde Technologies, Inc., Wilson, NC (US)

( * ) Notice: Subject to any disclaimer, the term of this patent is extended or adjusted under 35 U.S.C. 154(b) by 408 days.

(21) Appl. No.: 12/489,383

(22) Filed: Jun. 22, 2009

(65) Prior Publication Data

US 2010/0321212 A1 Dec. 23, 2010

(51) Int. Cl.
*G08B 21/00* (2006.01)

(52) U.S. Cl. ..... 340/945; 340/628

(58) Field of Classification Search ..... 340/945, 340/628

See application file for complete search history.

(56) References Cited

U.S. PATENT DOCUMENTS

| | | | | |
|---|---|---|---|---|
| 4,754,150 | A | 6/1988 | Orioka et al. | |
| 4,862,147 | A | 8/1989 | Thomas | |
| 4,870,394 | A * | 9/1989 | Corl et al. | 340/630 |
| 4,896,966 | A | 1/1990 | Boisseau et al. | |
| 4,896,967 | A | 1/1990 | Douglas-Hamilton et al. | |
| 4,939,455 | A | 7/1990 | Tsugawa | |
| 5,625,346 | A | 4/1997 | Shim et al. | |
| 5,764,149 | A | 6/1998 | Patel et al. | |
| 5,767,776 | A | 6/1998 | Wong | |
| 5,808,541 | A | 9/1998 | Golden | |
| 5,966,077 | A | 10/1999 | Wong | |
| 6,106,140 | A * | 8/2000 | Krummer et al. | 362/471 |
| 6,111,511 | A * | 8/2000 | Sivathanu et al. | 340/577 |
| 6,166,647 | A | 12/2000 | Wong | |
| 6,181,251 | B1 * | 1/2001 | Kelly | 340/628 |
| 6,211,626 | B1 | 4/2001 | Lys et al. | |
| 6,225,910 | B1 | 5/2001 | Kadwell et al. | |
| 6,326,897 | B2 | 12/2001 | Kadwell et al. | |
| 6,377,183 | B1 | 4/2002 | Baker et al. | |
| 6,459,919 | B1 | 10/2002 | Lys et al. | |
| 6,520,451 | B1 | 2/2003 | Moore | |
| 6,619,589 | B2 | 9/2003 | Brasseur et al. | |
| 6,653,942 | B2 | 11/2003 | Kadwell et al. | |
| 6,957,569 | B1 | 10/2005 | Napier et al. | |
| 6,967,582 | B2 * | 11/2005 | Tice et al. | 340/630 |
| 7,019,283 | B2 * | 3/2006 | Howe | 250/239 |
| 7,038,398 | B1 | 5/2006 | Lys et al. | |
| 7,154,388 | B2 * | 12/2006 | Mazzone | 340/520 |
| 7,204,534 | B2 | 4/2007 | Kelly | |
| 7,308,296 | B2 | 12/2007 | Lys et al. | |

(Continued)

FOREIGN PATENT DOCUMENTS

| | | |
|---|---|---|
| GB | 2412000 | 9/2005 |

(Continued)

OTHER PUBLICATIONS

European Search Report, EP Application No. 10251125.05-2215, dated Sep. 22, 2010.

*Primary Examiner* — Eric M Blount

(74) *Attorney, Agent, or Firm* — Carlson Gaskey & Olds, P.C.

(57) ABSTRACT

A combined smoke detector and lighting unit includes a smoke detector sensor mounted to a housing, a light source mounted to the housing, and an electrical interface mounted to the housing. The electrical interface is in electrical communication with the smoke detector and the light source.

14 Claims, 1 Drawing Sheet

U.S. PATENT DOCUMENTS

| | | | | |
|---|---|---|---|---|
| 7,324,004 | B2 | 1/2008 | Van Winkle et al. | |
| 7,333,129 | B2 | 2/2008 | Miller et al. | |
| 7,356,343 | B2 | 4/2008 | Feher | |
| 7,525,254 | B2 | 4/2009 | Lys et al. | |
| 7,576,659 | B2 * | 8/2009 | Lax | 340/628 |
| 2003/0058114 | A1 * | 3/2003 | Miller et al. | 340/577 |
| 2005/0258309 | A1 * | 11/2005 | Guard | 244/118.1 |
| 2007/0285262 | A1 * | 12/2007 | Lax | 340/628 |

FOREIGN PATENT DOCUMENTS

| | | |
|---|---|---|
| WO | 9936892 | 7/1999 |
| WO | 2005116519 | 12/2005 |

* cited by examiner

COMBINED SMOKE DETECTOR AND LIGHTING UNIT

BACKGROUND

The present disclosure relates to an aircraft cargo bay, and more particularly to a combined smoke detector and lighting unit therefor.

Transport and passenger aircraft often incorporate both smoke detectors and cargo bay lighting within the cargo bay. The smoke detectors and cargo bay lights are independent systems which utilize independent mounting provisions and wiring. The independent systems result in additional weight to the aircraft. Furthermore, cost of the cargo bay liners which house the lights and detectors are more expensive as they must be designed and manufactured to facilitate both technologies.

SUMMARY

A combined smoke detector and lighting unit according to an exemplary aspect of the present disclosure includes a smoke detector sensor mounted to a housing, a light source mounted to the housing, and an electrical interface mounted to the housing. The electrical interface is in electrical communication with the smoke detector and said light source.

An aircraft cargo bay according to an exemplary aspect of the present disclosure includes a cargo bay liner. A housing is mounted to said cargo bay liner to include a smoke detector and a light source with an electrical interface mounted to the housing, the electrical interface in electrical communication with the smoke detector and the light source.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
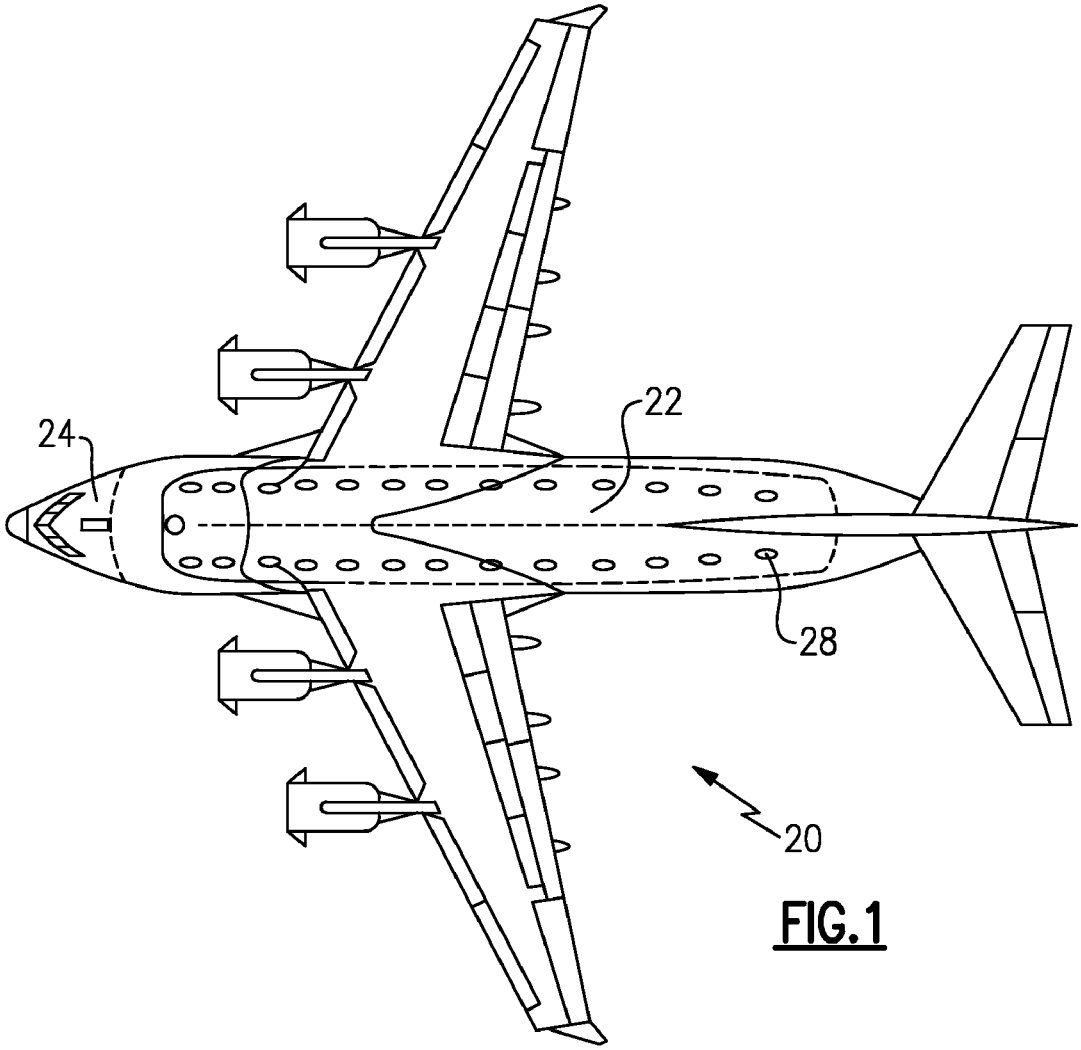
FIG. 1 is a perspective view of an aircraft having a cargo bay system according to the present disclosure.

FIG. 1 schematically illustrates an exemplary aircraft 20 generally having a cargo bay 22 and a cockpit area 24. Although a particular aircraft configuration is illustrated and described in the disclosed embodiment, other configurations and/or machines such as rotary-wing aircraft, ships and ground vehicles with cargo bays, lavatories, crew rest areas, electronic bays and other areas will also benefit herefrom.

Figure 2:
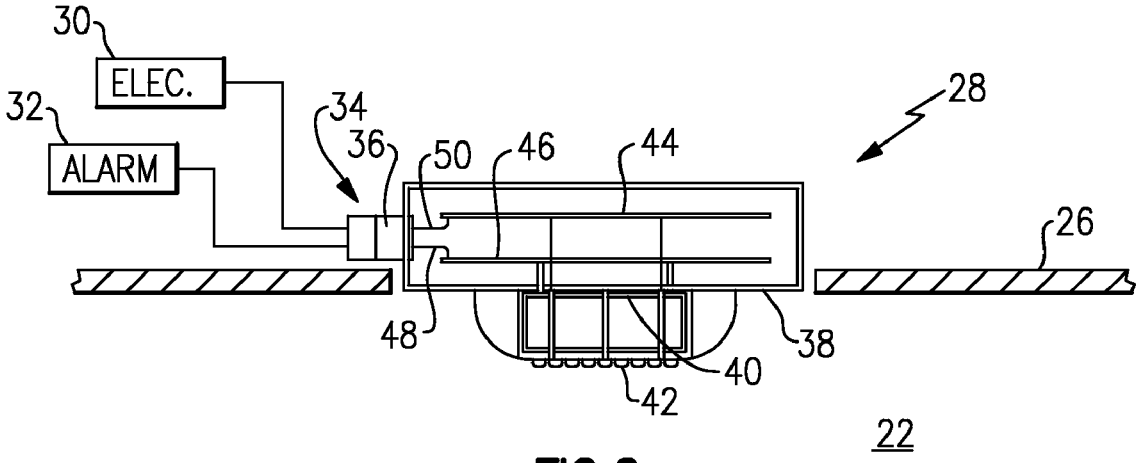
FIG. 2 is a schematic diagram of a combined smoke detector and lighting unit.

Referring to FIG. 2, the cargo bay 22 includes a cargo bay liner 26 to which is mounted at least one combined smoke detector and lighting unit 28. It should by understood that cargo bay liner 26 as utilized herein may be any surface within the cargo bay 22 to which a light or smoke detector is conventionally mounted and that the location of the cargo bay liner 26 disclosed in the illustrated non-limiting embodiment is schematic. The combined smoke detector and lighting unit 28 integrates a cargo bay light system into a smoke detector system to provide uniform lighting and fire and smoke identification throughout the cargo bay 22. Each combined smoke detector and lighting unit 28 communicates with an aircraft electrical system 30 and alert system 32 (illustrated schematically) through a common electrical interface 34 to facilitate integration within the cargo bay 22. The common electrical interface 34 in one non-limiting embodiment includes a connector plug 36 which facilitate direct installation to the pre-existing aircraft electrical system 30 and alert system 32.

The combined smoke detector and lighting unit 28 generally includes a housing 38, a smoke detector sensor 40, a light source 42 and the common electrical interface 34. The housing 38, in one non-limiting embodiment, contains the drive electronics 44 for the smoke detector sensor 40 and the drive electronics 46 for the light source 42 as well as the respective wiring harnesses 48, 50 which connect to the common electrical interface 34. It should be understood that although the drive electronics 44, 46 and the respective wiring harnesses 48, 50 are schematically illustrated separately in the illustrated non-limiting embodiment, these components may be integrated in various combinations.

The smoke detector sensor 40 may be arranged at upper elevations within the cargo bay 22 where the buoyancy differences between ambient air and heated air or smoke are readily identifiable and where the light source 42 provides effective illumination. That is, the cargo bay liner 26 is located in an upper surface of the aircraft cargo bay 22. Heated air or smoke generally tend to rise quickly to upper elevations and would therefore be detected by the elevated positions of the smoke detector sensor 40. It should be understood that other detectors may be provide herewith.

The light source 42, in one non-limiting embodiment may be a LED lighting unit which includes LED lights and the associated electronics.

The combined smoke detector and lighting unit 28 will result in reduced aircraft wiring, reduced weight, and reduced aircraft system costs. Moving from independent cargo bay light and smoke detector systems to a single system will improve overall reliability. The combined smoke detector and lighting unit 28 also facilitates installation at aircraft manufacture and result in fewer maintenance procedures and associated costs once fielded. Cargo bay liner manufacture will also be simplified and costs will be reduced as the independent mounting provisions and wiring will not be required.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. An aircraft cargo bay comprising:

a cargo bay liner;

a housing mounted to said cargo bay liner;

a smoke detector sensor mounted to said housing;

a light source mounted to said housing; and an electrical interface mounted to said housing, said electrical interface in electrical communication with said smoke detector and said light source.

2. The aircraft cargo bay as recited in claim 1, wherein said light source is a LED lighting unit.

3. The aircraft cargo bay as recited in claim 1, further comprising an aircraft electrical system in electrical communication with said electrical interface.

4. The aircraft cargo bay as recited in claim 1, further comprising an aircraft alert system in electrical communication with said electrical interface.

5. The aircraft cargo bay as recited in claim 1, wherein said electrical interface includes a connector plug.

6. The aircraft cargo bay as recited in claim 1, wherein said cargo bay liner is located in an upper surface of the aircraft cargo bay.

7. The aircraft cargo bay as recited in claim 1, wherein said cargo bay liner is arranged in an upper surface within said aircraft cargo bay.

8. The aircraft cargo bay as recited in claim 1, wherein said housing extends at least partially through said liner.

9. The aircraft cargo bay as recited in claim 1, wherein said electrical interface is common to both an aircraft electrical system and an aircraft alert system.

10. The aircraft cargo bay as recited in claim 9, wherein said electrical interface includes a connector plug, said connector plug facilitates a direct installation to said aircraft electrical and alert systems.

11. The aircraft cargo bay as recited in claim 10, wherein said connector plug is mounted to said housing.

12. The aircraft cargo bay as recited in claim 11, wherein said connector plug is mounted to said housing on a side of said cargo bay liner facing away from said aircraft cargo bay.

13. The aircraft cargo bay as recited in claim 1, wherein only one electrical interface is mounted to said housing.

14. The aircraft cargo bay as recited in claim 1, wherein said light source illuminates said cargo bay.

* * * * *